US005300004A

United States Patent [19]

Muehlenbein

[11] Patent Number: 5,300,004

[45] Date of Patent: Apr. 5, 1994

[54] ABDOMEN EXERCISER AND METHOD OF USING SAME

[75] Inventor: James A. Muehlenbein, Rockton, Ill.

[73] Assignee: Novel Products, Inc., Rockton, Ill.

[21] Appl. No.: 969,442

[22] Filed: Oct. 30, 1992

[51] Int. Cl.[5] ..... A63B 26/00

[52] U.S. Cl. ..... 482/140; 482/142; 482/908

[58] Field of Search ..... 482/114, 121, 123, 140, 482/142, 148, 133, 907, 13, 23, 51-59, 70-74, 79, 91-95, 99

[56] References Cited

U.S. PATENT DOCUMENTS

| | | | |
|---|---|---|---|
| 1,982,843 | 12/1934 | Traver | 482/70 |
| 3,559,986 | 2/1971 | Ehrmantraut | 482/70 |
| 4,506,884 | 3/1985 | Hankin | 482/902 |
| 5,147,266 | 9/1992 | Ricard | 482/907 |

FOREIGN PATENT DOCUMENTS

| | | | |
|---|---|---|---|
| 2411198 | 9/1975 | Fed. Rep. of Germany | 482/70 |

*Primary Examiner*—Stephen H. Crow
*Assistant Examiner*—Jerome Donnelly

[57] ABSTRACT

A device providing a sensory indication that the hands of a user executing a sit-up have moved a selected distance desired for proper execution of the sit-up, including an adjustable width base plate having substantially parallel channels disposed on opposite sides thereof, and slide plates disposed in each channel and having an upper surface engageable with the hands of a user, the slide plates being movable the selected distance in the channels between the channel ends. Users of the device consistently, uniformly perform a sit-up which minimizes unnecessary strain on the person's back by first positioning themselves in a starting position on their backs and on the device with their arms extended lengthwise of and parallel to their body. Their hands are then positioned on top of the slide plate positioned with its back end abutting the trailing end of the channel. Each sit-up is then performed by the person elevating his head and shoulders to cause lengthwise movement of his arms which in turn moves the plate in the channel, halting the elevating of his head and shoulders upon feeling the front end of the slide plate strike the leading end of the channel, and finally lowering his head and shoulders to the starting position.

12 Claims, 2 Drawing Sheets

ABDOMEN EXERCISER AND METHOD OF USING SAME

BACKGROUND OF THE INVENTION

1. Technical Field

The present invention is directed toward an exercise apparatus and, more particularly, toward an apparatus for facilitating proper execution of a situp.

2. Background Art

For many years, a person wishing to exercise his abdomen by performing situps would do so by lying with his back on the floor, his knees bent, his feet flat and secured to on the floor and his hands behind his head with his elbows sticking forward. The person would then lift his head and shoulders using his abdomen muscles to the point where his elbows touched his knees. This form of executing situps was found to put undue stress on a person's back, resulting in discomfort and, sometimes, injury.

Subsequently, "crunch-type" situps or "crunches" became widely used. This type of situp was executed in the same manner as the traditional situp, except the person would raise his head and shoulders a limited distance, for example, six inches, off the ground and then return to the starting position. This type of situp, while relieving the stress on the back, was found not to optimize the exercise on the abdomen as a person would often achieve additional leverage by pulling his head toward his chest by the use of his hands behind his head.

Health professionals and exercise consultants then recommended that people perform crunches with their arms extended parallel to and lengthwise of their body and then lifting their head and shoulders a prescribed distance to execute the situp. Health professionals and exercise consultants determined that for an adult the optimum distance to move the hands forward was four and one half inches and for a child the distance was three inches. Further, such a procedure is used not only for exercise, but for testing. However, if these "crunches" are not consistently performed, medical personnel cannot reliably compare test results with results from previous tests on the same person, or with other tests performed by other persons.

Heretofore, the prior art has failed to provide a satisfactory device for ensuring that such crunches be consistently performed as desired. For example, one method typically used has been to position a person flat on the floor with their arms extended and then place a piece of tape on the floor four and one half inches from the person's fingertips. However, this method has numerous disadvantages. First, placing tape on some floors is highly undesirable (for example, the tape may not stay in place on carpeted floors, and on tile floors may be difficult to remove). Second, if the person does not slide their fingertips along the floor, they may miss the tape and "crunch" too far. However, if they do slide their fingertips on the floor, they will typically both irritate their fingers (particularly on carpeted floors) and get very dirty hands. Third, the person will often slides along the floor to some degree while they do the "crunches", so that the tape will no longer be positioned precisely four and one half inches from the person's fingertips at the beginning of those "crunches", with the result being that many of the "crunches" will not be correct.

The present invention is directed toward overcoming one or more of the problems discussed above.

SUMMARY OF THE INVENTION

A device providing a sensory indication that the hands of a user executing a sit-up have moved a selected distance desired for proper execution of the sit-up is disclosed. The device includes an adjustable base plate having substantially parallel channels disposed on opposite sides thereof, the spacing between the channels being variable by adjustment of the base plate. Slide plates disposed in each channel have upper surfaces engageable with the hands of a user, and are movable the selected distance in the channels between the channel ends.

In another aspect of the present invention, a method for consistently, uniformly performing a sit-up so as to minimize unnecessary strain on the person's back, comprising the steps of first providing a device as described above, then placing the person in a starting position upon the limiting device wherein the person is lying on his back and extending his arms lengthwise of and parallel to his body, then engaging a hand of the person on top of the plate with the plate being positioned with its back end abutting the trailing end of the channel. Each sit-up is then performed by the person elevating his head and shoulders to cause lengthwise movement of his arms which in turn moves the plate in the channel, halting the elevating of his head and shoulders upon feeling the front end of the slide plate strike the leading end of the channel, and finally lowering his head and shoulders to the starting position at which position the rear end of the slide plate will again strike the trailing end of the channel.

It is one object of the present invention to permit a person to reliably and consistently perform a sit-up while lifting her head and shoulders only that amount determined by researchers to yield optimal results without undue discomfort or injury to the person.

It is another object of the present invention to provide an abdomen exerciser which permits a person to consistently perform a sit-up to provide reliable information to health professionals in determining the level of performance in standard fitness tests.

It is still another object of the present invention to provide an inexpensive abdomen exerciser which may be easily and inexpensively used with all sizes of persons.

It is yet another object of the present invention to allow a person to perform proper form sit-ups without irritating and/or dirtying her hands.

Still another object of the present invention is to permit a person to consistently perform numerous proper form sit-ups notwithstanding the fact that the person might slide slightly on the floor while performing the sit-ups.

DETAILED DESCRIPTION OF THE PREFERRED EMBODIMENT

Figure 1:
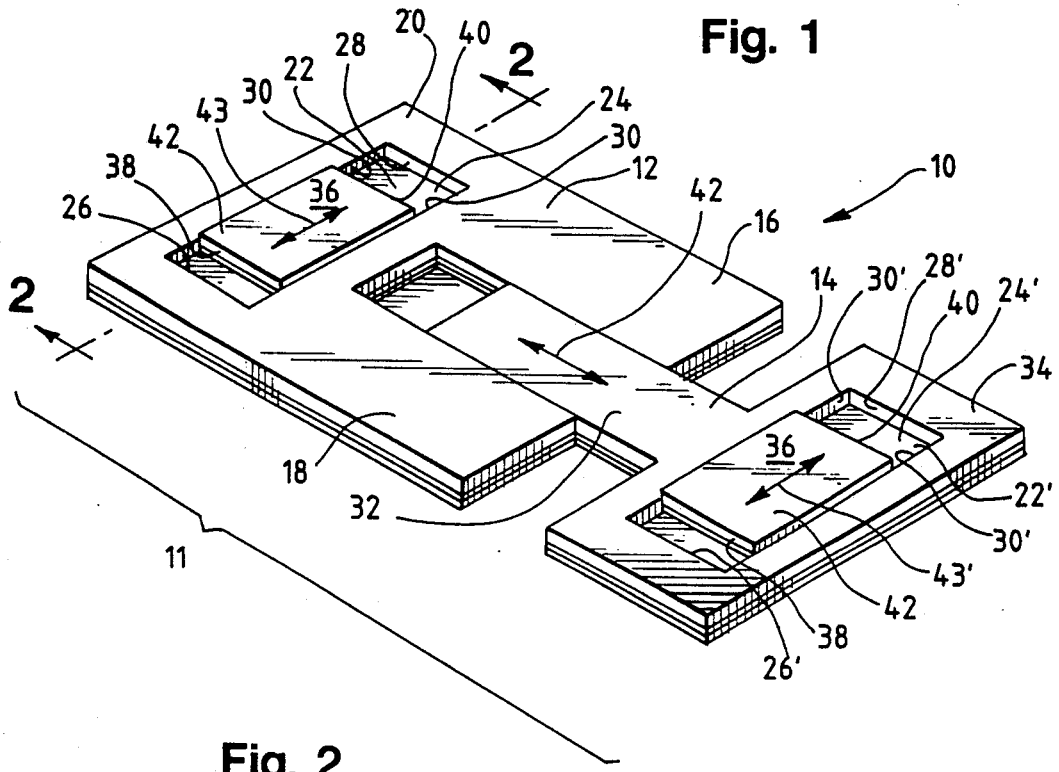
FIG. 1 is a perspective view of the abdomen exerciser of the present invention.
Figure 2:
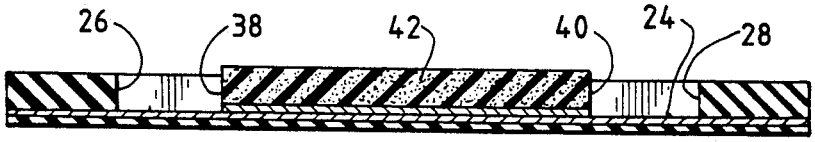
FIG. 2 is a cross-section view taken along line 2—2 of FIG. 2.

The abdomen exerciser 10 of the present invention includes a base plate 11 of first and second base plate segments 12,14. The first base plate segment 12 has a pair of spaced legs 16,18 extending in parallel from a body 20. The first base plate 12 further includes a channel 22 in the body having a non-stick surface 24. The channel 22 includes a leading end 26 and a trailing end 28 joined by a pair of sidewalls 30.

The second base plate 14 has a single leg 32 extending from the center of a body 34. As seen in FIG. 1, the single leg 32 of the second plate segment 14 is disposed between the first and second legs 16,18 of the first base plate 12. The body 34 of the second base plate segment 14 includes a channel 22' which is identical to the channel 22 in the first base plate segment with identical elements being indicated with the same reference numeral, only having a prime.

Disposed in the channel 22 is a slide plate 36 having a front end 38 and a back end 40 associated with the leading and trailing ends 26,28 of the channel 22 as described hereafter. The slide plate 36 further includes a pad 42 on the upper surface thereof. The slide plate 36 may slide lengthwise of the base 11 as indicated by the arrow 43. An identical slide plate 36' is disposed in the channel 22' in the body 34 of the second base plate segment 14, with identical elements being indicated with the same reference number, only having a prime.

The first and second base plate segments 12,14 in their slidably engaged position provide a base plate which can be of varying widths. The width can be increased by moving the base plate segments away from each other and decreased by moving the base plate segments toward each other as indicated by the arrow 42. The slide plates 36, 36' slide between the leading and trailing ends 26,28 and 26', 28' of the channels 22,22' a selected distance indicated by the arrows 43,43'.

Figure 5:
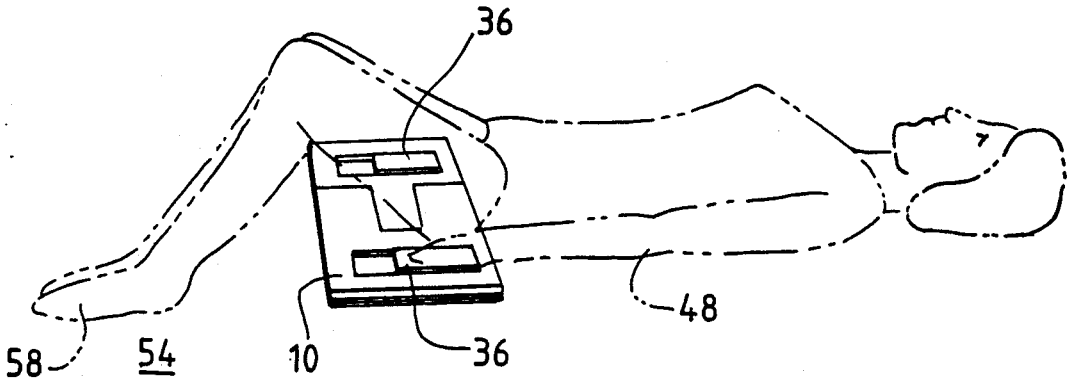
FIG. 5 is a person using the abdomen exerciser of the present invention in a starting position.
Figure 6:
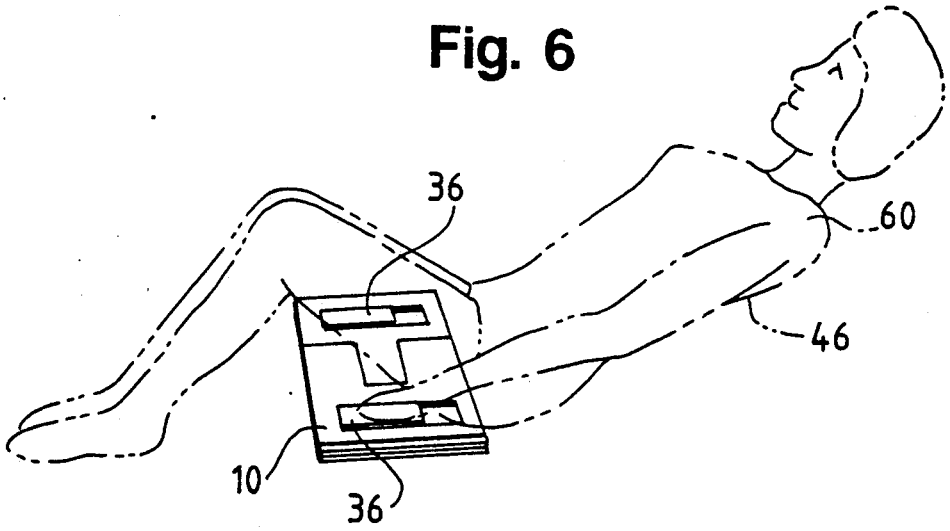
FIG. 6 is a person using the abdomen exerciser of the present invention completing a sit-up.

FIGS. 5 and 6 illustrate use of the abdomen exerciser 10. The width of the base plate 11 is adjusted in the manner discussed above so that the slide plates 36,36' are spaced approximately the same amount as the spacing of the hands of the person using the exerciser 10. More specifically, when properly adjusted for use, the exerciser 10 will be positioned beneath a person lying flat on her back 46 such as shown in FIG. 5 so that the person's arms 48 may be extended lengthwise and parallel to her body 50 with her hands on top of the slide plates 36,36' positioned so as to abut the trailing ends 28,28' of the channels 22,22'.

When the person using the exerciser 10 is properly positioned to start (that is, flat on her back 46 with her arms 48 extending lengthwise and parallel to her body 50, her head 52 resting on the floor 54 and her knees 56 bent and her feet 58 flat on the floor, and the abdomen exerciser 10 positioned as described above), the person lifts her head 52 and shoulders 60 off the ground a sufficient distance so that her arms 48 move the slide plates 36,36' lengthwise in the channels 22,22' until the front ends 38,38' of the slide plates 36,36' engage the leading edges 26,26' of the channels 22,22'. Such engagement provides a sensory indication to the exercising person (who obviously cannot readily see how far her hands have moved) that she has "crunched" the desirable amount, as which point the person then returns her head 52 and shoulders 60 to the floor 54. This procedure is repeated as many times as required for testing or as desired for exercising.

It should be recognized that this exerciser 10 is also essentially "self correcting" for any sliding which the person may do as she performs multiple "crunches". Therefore, even if a person slides up toward her head relative to the exerciser 10 while performing the crunches as often occurs (the person's bent legs will typically tighten up during exercising so that they will essentially push her up toward her head from her feet), subsequent "crunches" will be done correctly. That is, when the person returns to the initial position flat on her back, if she has pushed herself toward her head, her arms will pull the slide plates 36,36' against the trailing ends 28,28' of the channels 22,22' before she has fully returned to the position flat on her back. As a result, when she moves that last extra bit to be positioned flat on her back, her hands will naturally slide slightly over the slide plates 36,36' so that, when she begins her next "crunch", her hands will be positioned where they should be to get a sensory indication when the next "crunch" has been performed precisely the desired four and one half inch amount. Still further, in the far less typical event that she were to slide in the opposite direction (i.e., toward her feet), she would receive a sensory indication of that since, when returning to the initial position flat on her back she would not feel the slide plates 36,36' engage the trailing ends 28,28' of the channels 22,22'. In that case, she would recognize that she should reposition her hands on the slide plates 36,36' so that the plates do engage the channel trailing ends 28,28' while she is flat on her back so that, again, subsequent "crunches" will continue to be properly performed.

Figure 3:
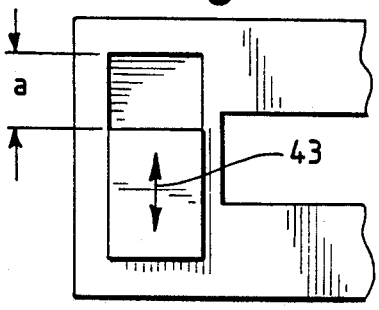
FIG. 3 is a fragmented plan view of a channel of the abdomen exerciser.
Figure 4:
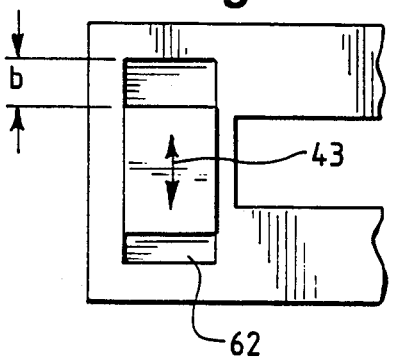
FIG. 4 is a fragmented plan view of the channel of FIG. 3 including an insert effectively decreasing the length of the channel.

As previously noted, research has revealed that the optimum distance for an adult to move her arms lengthwise of her body while executing a "crunch"-type situp is four and one half inches. Accordingly, the space "a" of FIG. 3 is four and one half inches. With a child, however, the optimum distance is three inches. Thus, a spacer 62 one and one half inches wide (see FIG. 4) may be provided to limit the distance "b" to three inches, or a substitute slide plate one and one half inches greater in length may be provided. Alternatively, where exercisers are supplied intended for use by children only, the channels 22,22' could be formed one and one half inches shorter in length than those provided for adults.

The abdomen exerciser of the present invention permits a person to reliably and consistently perform a situp while lifting her head and shoulders only that amount determined by researchers to yield optimal results without discomfort or injury to the person's back. The abdomen exerciser further facilitates a uniform crunch-type situp to aid health professionals in determining the level of performance in standard fitness tests. Because the width of the abdomen exerciser is adjustable, persons of differing body widths can use the device. The non-stick surface in the channels facilitates smooth sliding of the slide plates within the channel. Moreover, the abdomen exerciser provides slide plates which keep the users hands off the floor while exercising, keeping them clean and preventing irritation from the floor surface.

Still other aspects, objects, and advantages of the present invention can be obtained from a study of the specification, the drawings, and the appended claims.

I claim:

1. A device for limiting lengthwise movement of the arms of a user during execution of a sit-up of the type performed by a user lying on his back with his arms extended lengthwise of and parallel to his body, and the user then elevating his head and shoulders, thereby causing lengthwise movement of his arms, the device comprising:

a base plate including a midsection adapted to support a user thereon, said base plate having a length and a width and a pair of substantially parallel elongated channels disposed along the base plate length on opposite sides of the midsection, each of said channels having spaced apart ends; and slide plates slidably disposed in each channel, said slide plates each having an upper surface engagable with the hands of a user and being independently movable a selected distance between the ends of the channels while a user supported on said midsection executes an exercise involving a situp motion.

2. The device of claim 1 wherein the base plate includes means for varying its width.

3. The device of claim 2 wherein the width varying means comprises first and second adjacent base plate segments, the first and second base plate segments slidably interlocking, the width being increased by sliding the segments away from each other and decreased by sliding the segments toward each other within a selected range of widths.

4. The device of claim 1 wherein said slide plates provide a sensory indication of a selected distance of travel of both arms of a user.

5. The device of claim 1, further comprising a pad on each slide plate for engaging the hand of a user.

6. The device of claim 1, wherein each channel has a bottom having a non-stick surface.

7. A device providing sensory indication that the hands of a user executing a sit-up have moved a selected distance desired for proper execution of the sit-up, comprising:

a base plate including a midsection adapted to support a user thereon, said base plate having a length and a width and a pair of substantially parallel elongated channels along the base plate length on opposite sides of the midsection, each of said channels having spaced apart ends;

means for adjusting the spacing between the channels; and slide plates slidably disposed in each channel, said slide plates each having an upper surface engageable with the hands of a user and being movable the selected distance between the ends of the channels while a user supported on the midsection executes an exercise involving a situp motion.

8. The device of claim 7 wherein the spacing adjusting means comprises first and second adjacent base plate segments, the first and second base plate segments slidably interlocking, the width being increased by sliding the segments away from each other and decreased by sliding the segments toward each other within a selected range of widths.

9. The device of claim 7 wherein the upper surface of the slide plates is frictionally engageable with the hands of a user.

10. The device of claim 7 further comprising means for adjusting the channel length to provide different selected distances between said channel ends.

11. A method for consistently, uniformly performing a sit-up so as to minimize unnecessary strain on the person's back, comprising the steps of:

(a) providing a device giving the person a sensory indication that his arms have moved lengthwise a selected amount, the device including a base plate including a midsection adapted to support a user thereon, said base plate having a length and a width and a pair of substantially parallel elongated channels disposed along the base plate length on opposite sides of the midsection, each of said channels having spaced apart leading and trailing ends, and Slide plates slidably disposed in each channel, said slide plates each having an upper surface engagable with the hands of a user and being independently movable between the leading and trailing ends of the channel;

(b) placing the person in a starting position upon the limiting device wherein the person is lying on his back and on the midsection and extending his arms lengthwise of and parallel to his body;

(c) engaging a hand of the person on top of the plate, said plate being positioned with its back end abutting the trailing end of the channel;

(d) the person elevating his head and shoulders to cause lengthwise movement of his arms which in turn moves the plate in the channel;

(e) the person halting the elevating of his head and shoulders upon feeling the front end of the slide plate strike the leading end of the channel; and (f) the person lowering his head and shoulders to the starting position.

12. The method of claim 11 wherein steps (d) through (f) are repeated as desired.

* * * * *